US011776804B2

(12) United States Patent
Bezel et al.

(10) Patent No.: US 11,776,804 B2
(45) **Date of Patent: *Oct. 3, 2023**

(54) LASER-SUSTAINED PLASMA LIGHT SOURCE WITH REVERSE VORTEX FLOW

(71) Applicant: KLA Corporation, Milpitas, CA (US)

(72) Inventors: Ilya Bezel, Mountain View, CA (US); Leonid Borisovich Zvedenuk, Moscow (RU); Andrey Evgenievich Stepanov, Moscow (RU); Vitaly K. Rerikh, Moscow (RU); Boris Vasilyevich Potapkin, Moscow (RU)

(73) Assignee: KLA Corporation, Milpitas, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/696,653

(22) Filed: Mar. 16, 2022

(65) Prior Publication Data

US 2022/0344146 A1 Oct. 27, 2022

Related U.S. Application Data

(60) Provisional application No. 63/178,552, filed on Apr. 23, 2021.

(51) Int. Cl.

| | |
|---|---|
| ***H01J 61/52*** | (2006.01) |
| ***H01J 65/04*** | (2006.01) |
| ***H05H 1/46*** | (2006.01) |

(52) U.S. Cl.

CPC ..... *H01J 61/52* (2013.01); *H01J 65/04* (2013.01); *H05H 1/46* (2013.01); *H01J 2893/0063* (2013.01)

(58) Field of Classification Search

CPC ..... H01J 47/002; H01J 47/026; H01J 61/12; H01J 61/16; H01J 61/30; H01J 61/36;

(Continued)

(56) References Cited

U.S. PATENT DOCUMENTS 4,179,599 A 12/1979 Conrad
5,608,526 A 3/1997 Piwonka-Corle et al.

(Continued)

FOREIGN PATENT DOCUMENTS

DE 102019121175 A1 * 1/2021 ..... B23K 26/083
JP 2020174560 A * 10/2020

(Continued)

OTHER PUBLICATIONS

International Search Report and Written Report in International Application No. PCT/US2022/025658 dated Aug. 9, 2022.

*Primary Examiner* — Abdullah A Riyami
*Assistant Examiner* — Syed M Kaiser
(74) *Attorney, Agent, or Firm* — Suiter Swantz pc llo

(57) ABSTRACT

A laser-sustained plasma (LSP) light source with reverse vortex flow is disclosed. The LSP source includes gas cell including a gas containment structure including a body, neck, and shaft. The gas cell includes one or more gas delivery lines for delivery gas to one or more nozzles positioned in or below the neck of the gas containment structure. The gas cell includes one or more gas inlets and one or more gas outlets arranged to generate a reverse vortex flow within the gas containment structure of the gas cell. The LSP source also includes a laser pump source configured to generate an optical pump to sustain a plasma in a region of the gas containment structure. The LSP source includes a light collector element configured to collect at least a portion of broadband light emitted from the plasma.

29 Claims, 12 Drawing Sheets

(58) Field of Classification Search
CPC .. H01J 61/52; H01J 61/54; H01J 63/02; H01J 65/04; H05H 1/46
See application file for complete search history.

(56) References Cited

U.S. PATENT DOCUMENTS

| | | | | |
|---|---|---|---|---|
| 5,837,958 | A * | 11/1998 | Fornsel | H05H 1/34 313/231.51 |
| 5,999,310 | A | 12/1999 | Shafer et al. | |
| 6,297,880 | B1 | 10/2001 | Rosencwaig et al. | |
| 7,345,825 | B2 | 3/2008 | Chuang et al. | |
| 7,435,982 | B2 | 10/2008 | Smith | |
| 7,525,649 | B1 | 4/2009 | Leong et al. | |
| 7,786,455 | B2 | 8/2010 | Smith | |
| 7,957,066 | B2 | 6/2011 | Armstrong et al. | |
| 7,989,786 | B2 | 8/2011 | Smith et al. | |
| 8,182,127 | B2 | 5/2012 | Yasuda et al. | |
| 8,309,943 | B2 | 11/2012 | Smith et al. | |
| 8,525,138 | B2 | 9/2013 | Smith et al. | |
| 8,921,814 | B2 | 12/2014 | Pellemans et al. | |
| 9,185,788 | B2 | 11/2015 | Bezel et al. | |
| 9,228,943 | B2 | 1/2016 | Wang et al. | |
| 9,263,238 | B2 | 2/2016 | Wilson et al. | |
| 9,318,311 | B2 | 4/2016 | Chimmalgi et al. | |
| 9,390,902 | B2 | 7/2016 | Bezel et al. | |
| 9,721,761 | B2 | 8/2017 | Wilson et al. | |
| 9,775,226 | B1 | 9/2017 | Bezel et al. | |
| 10,690,589 | B2 | 6/2020 | Bezel et al. | |
| 2003/0222586 | A1 | 12/2003 | Brooks et al. | |
| 2004/0149700 | A1 | 8/2004 | Bayer et al. | |
| 2014/0159572 | A1 | 6/2014 | Risby et al. | |
| 2016/0000499 | A1* | 1/2016 | Lennox | A61N 7/022 606/41 |
| 2020/0403555 | A1* | 12/2020 | Mills | G21B 3/004 |
| 2021/0092826 | A1 | 3/2021 | Bezel et al. | |
| 2021/0245133 | A1* | 8/2021 | Soane | C10G 53/08 |
| 2021/0321508 | A1* | 10/2021 | Bezel | H05H 1/46 |

FOREIGN PATENT DOCUMENTS

| | | | |
|---|---|---|---|
| RU | 2734111 | C1 * | 10/2020 |
| WO | 2020092236 | A9 | 4/2021 |

* cited by examiner

LASER-SUSTAINED PLASMA LIGHT SOURCE WITH REVERSE VORTEX FLOW

CROSS-REFERENCE TO RELATED APPLICATION

The present application claims the benefit under 35 U.S.C. § 119(e) of U.S. Provisional Application Ser. No. 63/178,552, filed Apr. 23, 2021, which is incorporated herein by reference in the entirety.

TECHNICAL FIELD

The present invention generally relates to a laser sustained plasma (LSP) broadband light source and, in particular, an LSP source including reverse vortex flow.

BACKGROUND

The need for improved light sources used for inspection of ever-shrinking semiconductor devices continues to grow. One such light source includes a laser sustained plasma (LSP) broadband light source. LSP broadband light sources include LSP lamps, which are capable of producing high-power broadband light. The gas in the vessel is typically stagnant as most current LSP lamps do not have any mechanisms for forcing gas flow through the lamp except for natural convection caused by the buoyancy of hot plasma plume. Previous attempts at flowing gas through LSP lamps have resulted in instabilities within the LSP lamp caused by unsteady turbulent gas flow. These instabilities are amplified at higher power and at locations of mechanical elements (e.g., nozzles), whereby high radiative thermal load on these mechanical elements is created, resulting in overheating and melting. As such, it would be advantageous to provide a system and method to remedy the shortcomings of the previous approaches identified above.

SUMMARY

A laser-sustained light source is disclosed. In one embodiment, the laser-sustained light source includes a gas containment structure for containing a gas, wherein the gas containment structure comprises a body, a neck, and a shaft. In another embodiment, the laser-sustained light source includes a plurality of nozzles position in or below the neck of the gas containment structure. In another embodiment, the laser-sustained light source includes a plurality of gas delivery lines fluidically coupled to the plurality of nozzles and configured to deliver gas to the plurality of nozzles. In another embodiment, the laser-sustained light source includes one or more gas inlets fluidically coupled to the gas delivery lines for providing gas into the plurality of gas delivery lines. In another embodiment, the laser-sustained light source includes one or more gas outlets fluidically coupled to the gas containment structure and configured to flow gas out of the gas containment structure, wherein the one or more gas inlets and the one or more gas outlets are arranged to generate a vortex gas flow within the gas containment structure. In another embodiment, the laser-sustained light source includes a gas seal positioned at a base of the gas containment structure. In another embodiment, the laser-sustained light source includes a laser pump source configured to generate an optical pump to sustain a plasma in a region of the gas containment structure within an inner gas flow within the vortex gas flow. In another embodiment, the laser-sustained light source includes a light collector element configured to collect at least a portion of broadband light emitted from the plasma.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures.

DETAILED DESCRIPTION OF THE INVENTION

Figure 1:
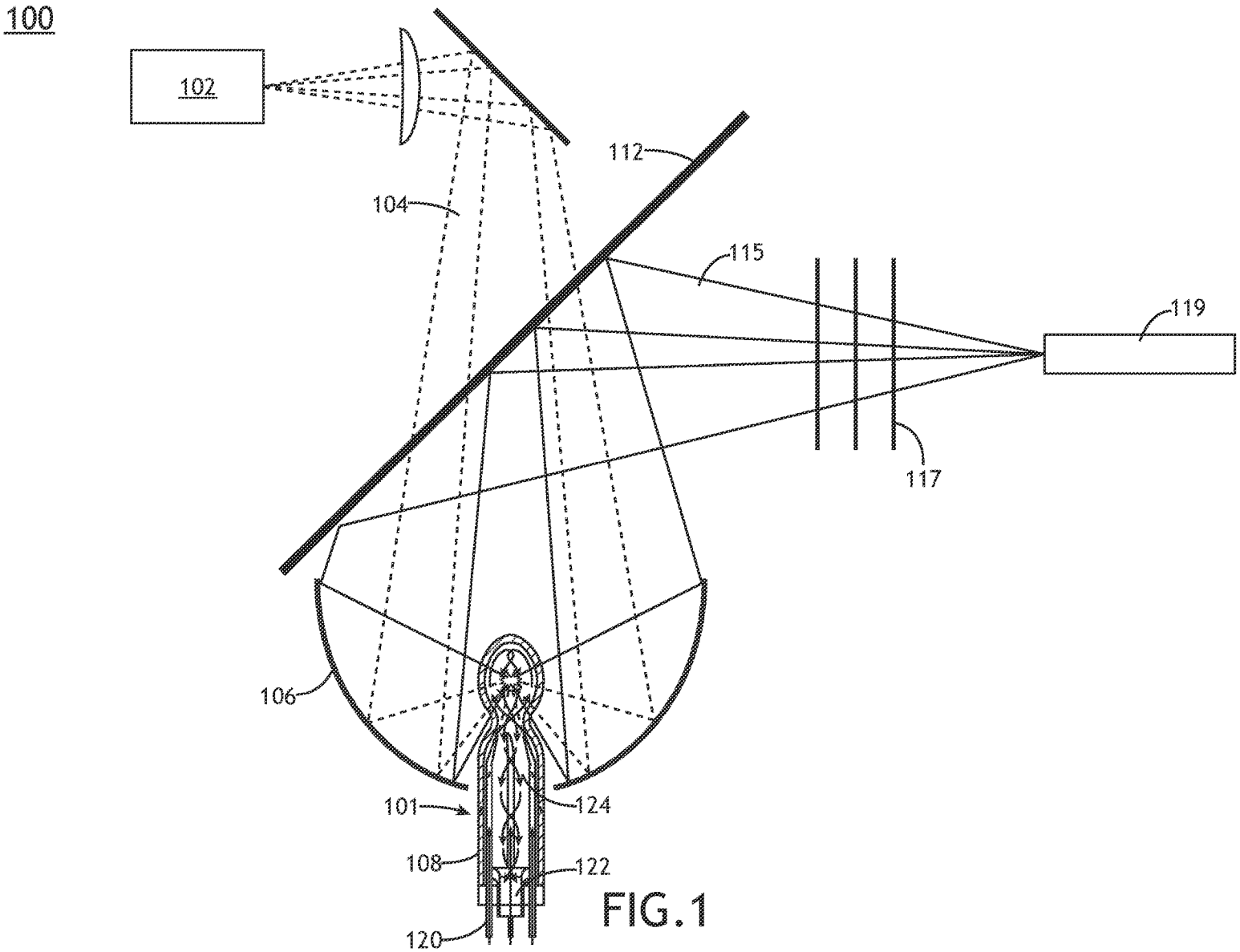
FIG. 1 is a schematic illustration of an LSP broadband light source, in accordance with one or more embodiments of the present disclosure.

The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure.

Reference will now be made in detail to the subject matter disclosed, which is illustrated in the accompanying drawings.

Embodiments of the present disclosure are directed to improvements in the operation of flow-through plasma cell designs for use in laser-sustained plasma light sources. One of the most significant limitations for plasma lamp operation is the thermal stress placed on the glass of the plasma lamp and any other construction elements placed in the vicinity of the plasma (e.g., electrodes, seals, etc.). In particular, positioning high-power plasma in the proximity of construction elements (e.g., nozzle orifice) creates a high radiative thermal load on these construction elements and results in overheating and melting. For flow-through designs, removing the convection control elements from the plasma to safe distance results in their reduced efficiency. For example, almost half of the flow emerging from gas inlets of other designs fails to propagate into the main body of the plasma cell. A flow-through plasma cell design is described in U.S. patent application Ser. No. 17/223,942, filed on Apr. 6, 2021, which is incorporated herein by reference in the entirety.

Cooling of the glass lamp envelope is another severe problem in high-power lamp operation. These heat sources include hot gas circulating within the plasma lamp and large amounts of plasma VUV radiation that is absorbed on the inside surface of the glass of the lamp. Glass cooling occurs on the outside of the cell, resulting in large thermal gradients across the thickness of the glass. In some cases, the thermal gradients can exceed 100° C./mm. This creates an unfavorable thermal regime where the inside surface of the glass is much hotter than the outside surface, thereby reducing the efficiency of cooling. Uneven temperature distribution also creates a likelihood of glass damage.

Embodiments of the present disclosure are directed to an LSP light source implementing reverse vortex flow to organize gas flow through the LSP region of the LSP light source. Embodiments of the disclosure are directed to a transparent bulb, cell, or chamber used to contain high-pressure gas needed for LSP operation and gas transport components (gas inlet(s), delivery lines, nozzles, and gas outlet(s)) used to produce the reverse-vortex gas flow. Embodiments of the present disclosure are directed to a set of gas nozzles arranged in or below the neck of a body of the gas containment structure of a gas cell. The gas nozzles are arranged to generate gas jets in a spiral pattern that impinge on an inner surface of the body of the gas containment structure, which serve to efficiently cool the gas containment structure.

FIG. 1 is a schematic illustration of an LSP light source 100 with reverse-vortex flow, in accordance with one or more embodiments of the present disclosure. The LSP source 100 includes a reverse-flow vortex cell 101. The LSP source 100 includes a pump source 102 configured to generate an optical pump 104 for sustaining a plasma 110 within the reverse-flow vortex cell 101. For example, the pump source 102 may emit a beam of laser illumination suitable for pumping the plasma 110. In embodiments, the light collector element 106 is configured to direct a portion of the optical pump 104 to a gas contained in a gas containment structure 108 of the vortex-producing cell 107 to ignite and/or sustain the plasma 110. The pump source 102 may include any pump source known in the art suitable for igniting and/or sustaining plasma. For example, the pump source 102 may include one or more lasers (i.e., pump lasers). The pump beam may include radiation of any wavelength or wavelength range known in the art including, but not limited to, visible, IR radiation, NIR radiation, and/or UV radiation. The light collector element 106 is configured to collect a portion of broadband light 115 emitted from the plasma 110.

The gas containment structure 108 may include one or more gas inlets 120 and one or more gas outlets 122, which are arranged to form a reverse-flow vortex 124 within the interior of the gas containment structure 108. The broadband light 115 emitted from the plasma 110 may be collected via one or more additional optics (e.g., a cold mirror 112) for use in one or more downstream applications (e.g., inspection, metrology, or lithography). The LSP light source 100 may include any number of additional optical elements such as, but not limited to, a filter 117 or a homogenizer 119 for conditioning the broadband light 115 prior to the one or more downstream applications. The gas containment structure 108 may include a plasma cell, a plasma bulb (or lamp), or a plasma chamber.

Figure 2:
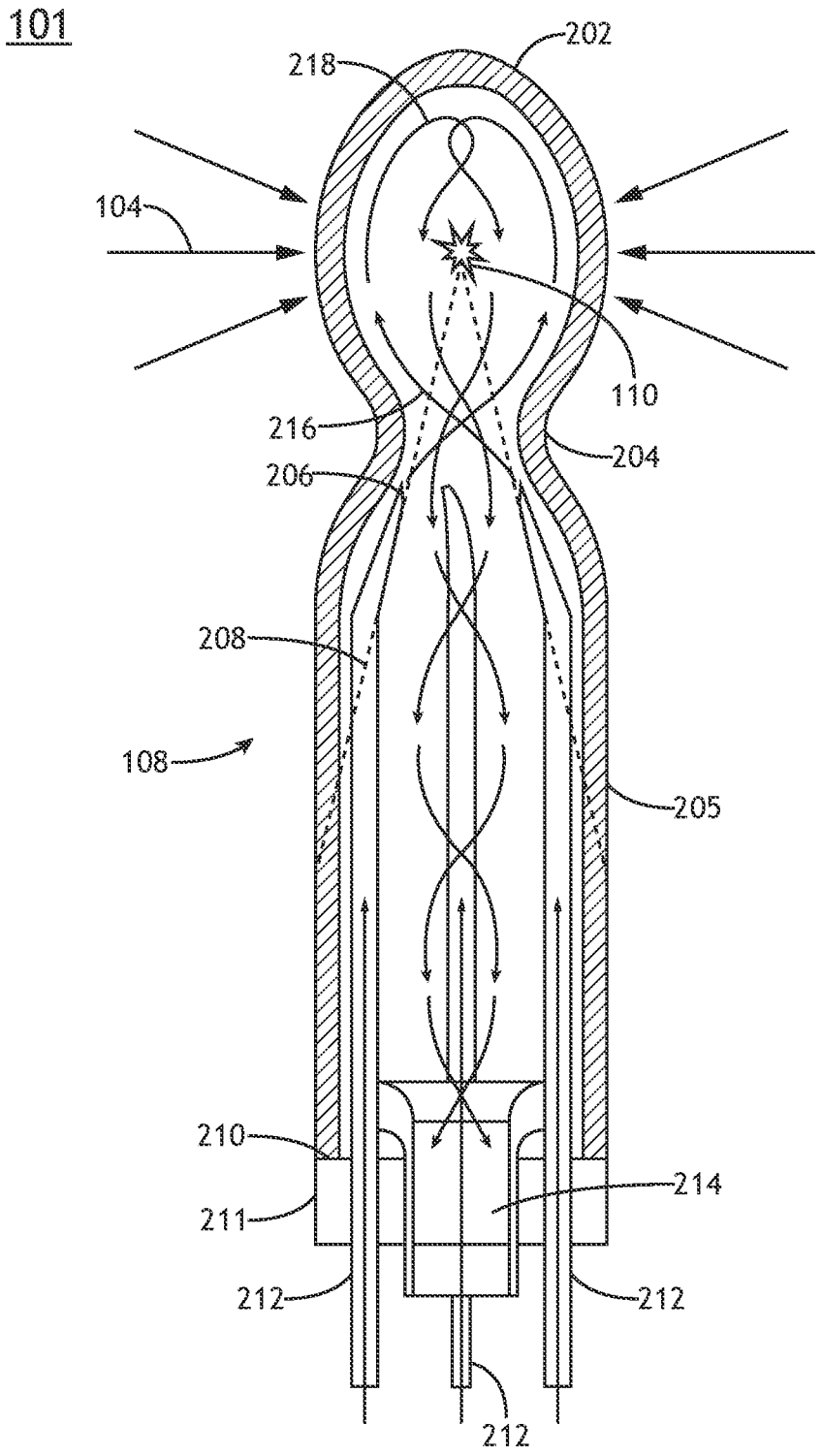
FIG. 2 is a schematic illustration of a reverse-flow vortex-generating gas cell for use in the LSP broadband light source, in accordance with one or more embodiments of the present disclosure.

FIG. 2 illustrates a simplified schematic view of the reverse-flow vortex cell 101, in accordance with one or more embodiments of the present disclosure. In embodiments, the gas containment structure 108 of the reverse-flow vortex cell 101 includes a body 202, a neck 204, and a shaft 206. In embodiments, the reverse-flow vortex cell 101 includes one or more nozzles 206. The one or more nozzles 206 may be positioned in or below the neck 204 of the gas containment structure 108. In embodiments, the reverse-flow vortex cell 101 includes one or more gas delivery lines 208. The one or more delivery lines 208 may direct gas through the shaft 208 to the one or more nozzles 206. The one or more delivery lines 208 may be formed in any suitable manner. For example, the one or more delivery lines 208 may be extruded.

In embodiments, the reverse-flow vortex cell 101 includes one or more gas inlets 202 configured to flow the gas into the reverse-flow vortex cell 101. For example, the reverse-flow vortex cell 101 includes a set of gas inlets 212 distributed along the periphery of the vortex cell 101 and configured to flow gas into the set of gas delivery lines 208, which in turn deliver gas to the set of gas nozzles 206. The reverse-flow vortex cell 101 also includes one or more gas outlets 214. For example, the reverse-flow vortex cell 101 may include a first gas outlet 214 located at a center location of the vortex cell 101.

In embodiments, the reverse-flow vortex cell 101 includes seal 210. For example, the seal 210 may include a glass-to-metal seal, which serves to hermetically couple the shaft 205 of the gas containment structure 108 to flange assembly 211. The flange assembly 211 may terminate/seal the glass portion of the gas containment structure 108. In embodiments, the flange assembly 211 may secure inlet and/or outlet pipes or tubes and additional mechanical and electronic components. The use of a flanged plasma cell is described in at least U.S. Pat. No. 9,775,226, issued on Sep. 26, 2017; and U.S. Pat. No. 9,185,788, issued on Nov. 10, 2015, which are each incorporated previously herein by reference in the entirety.

The gas containment structure 108 formed from an optically transmissive material (e.g., glass) configured for containing the plasma-forming gas and transmitting optical pump illumination 104 and broadband light 115. For example, the body 202 of the gas containment structure 108 may include a spherical section formed from a material transparent to at least a portion of the pump illumination 104 and the broadband light 115. It is noted that the body 202 is not limited to a spherical shape and may take on any suitable shape including, but not limited to, a spherical shape, an ellipsoidal shape, a cylindrical shape, and so on. The transmissive portion of the gas containment structure of the vortex cell 101 can be formed from any number of different optical materials. For example, the transmissive portion of the gas containment structure 108 may be formed from, but is not limited to, sapphire, crystal quartz, $CaF_2$, $MgF_2$, or fused silica. It is noted that the vortex flow of the vortex cell 101 keeps the hot plume of the plasma 110 from the walls of the vortex cell 101, which reduces the thermal head load on the walls and allows for the use of optical materials sensitive to overheating (e.g., glass, $CaF_2$, $MgF_2$, crystal quartz, and the like).

During operation, in embodiments, the set of nozzles 206 are configured to generate a set of gas jets 216 in a spiral pattern impinging on an inner surface of the body 202 of the gas containment structure 108. For example, the nozzles 206 direct fast-moving spiraling jets of gas into the body 202 of the gas containment structure 108. In this embodiment, the gas flow moves upward into body 202 and impinges on the wall of the body 202. Then, axial flow 218 reverses direction (moving downward) and leaves the body near the axis of neck 204 of the gas containment structure 108. The plasma 110, located at the axis in the region of reverse flow, creates hot plume of gas that is entrained and mixed with the return flow toward the centrally-located outlet 214.

It is noted that the reverse-flow vortex cell 101 serves to distance the various mechanical components of the vortex cell 101 (e.g., seal, outlet, inlet, and the like) from the plasma 110, thereby reducing thermal load on these elements. For example, the heat load on a swirler used in previous solutions that is located at 50 mm from a 20 kW plasma and absorbing 20% of plasma radiation is approximately 300 W and is likely to require additional cooling provisions (e.g., water cooling). In the case of the reverse-flow vortex cell 101 of this disclosure, the directly illuminated regions of the cell 101 are placed at much larger distance from the plasma 110, thereby reducing the heat load to about 20 W. This amount of heat can be easily removed by the gas passing through delivery lines 208 and nozzles 206. In embodiments, there is additional radiation protection for delivery lines placed in the shadow created by reduced diameter of the neck 204.

Another benefit of reverse-flow vortex cell of the present disclosure includes placement of the nozzles 206 very close to the neck 204 of cell 101 and directed into the divergent area of the body 202, which forms fast moving jets in the immediate vicinity of neck 204. The gas jets entrain additional gas into body 202, thereby increasing the efficiency of the gas flow (e.g., by a factor of about two). Without this feature, inefficiency may result from the cold inlet gas entrained by the back flow below the neck region.

Yet another benefit of the reverse-flow vortex cell 101 of the present disclosure includes directing the gas jets on the internal surface of body 202 of the cell 101. This provides more efficient cooling the glass of the cell 101 than cooling from the outside of the cell 101. The heat transfer coefficient (HTC) between cold gas and hot glass increases with gas density. Because of higher operating pressure, jets originating from nozzles 206 and impinging on the internal glass surface carry much denser gas than gas outside of the cell 101 and therefore have about 10 times higher HTC that can be achieved from outside of the cell 101. In addition, this cooling is applied to the same surfaces where the glass is heated by plasma radiation, resulting in very efficient cooling compared to traditional methods.

Figure 3:
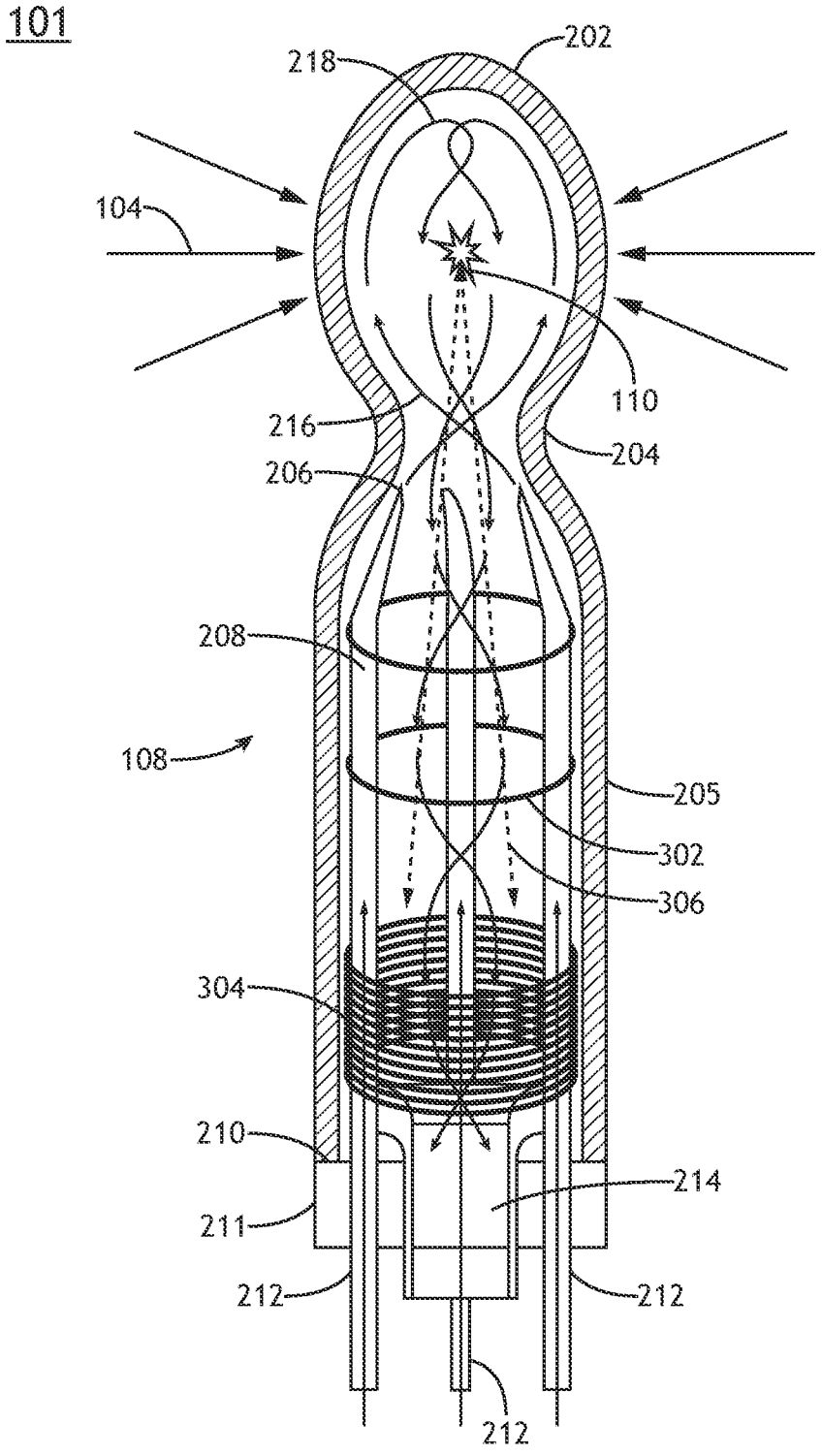
FIG. 3 is a schematic illustration of a reverse-flow vortex-generating gas cell including one or more bindings and radiation shielding, in accordance with one or more embodiments of the present disclosure.

FIG. 3 illustrates a schematic view of the reverse-flow plasma cell 101 including binding 302 and seal shielding 304, in accordance with one or more embodiments of the present disclosure. In embodiments, the binding 302 is applied to the delivery lines 208 or the nozzles 206 to stabilize the one or more nozzles 206. It is noted that there is a significant lateral recoil force expected to be applied to the nozzles 206. Typical gas volumes passing through a given nozzle is about 1 kg/s at 50 m/s. The change of momentum in response to the gas flow is approximately 20 N. In order to stabilize nozzle positions, the binding 302 can be applied to delivery lines 208 and/or nozzles 206 in a manner that connects them together in a rigid structure. In embodiments, the binding 302 may be positioned in the neck shadow protected from direct plasma radiation 306 from the plasma 110. The binding 302 may include any mechanical structure capable of stabilizing the position of the delivery lines and/or nozzles. For example, the binding 302 may include, but is not limited to, a wire wrapped around the set of deliver lines 208 and/or nozzles 206. In additional embodiments, the optical shielding 304 may be attached to the delivery lines 208 to protect the seal 210 (and other components) from direct plasma radiation 306 to reduce the thermal load on seal 210 and its light-induced degradation.

Figure 4:
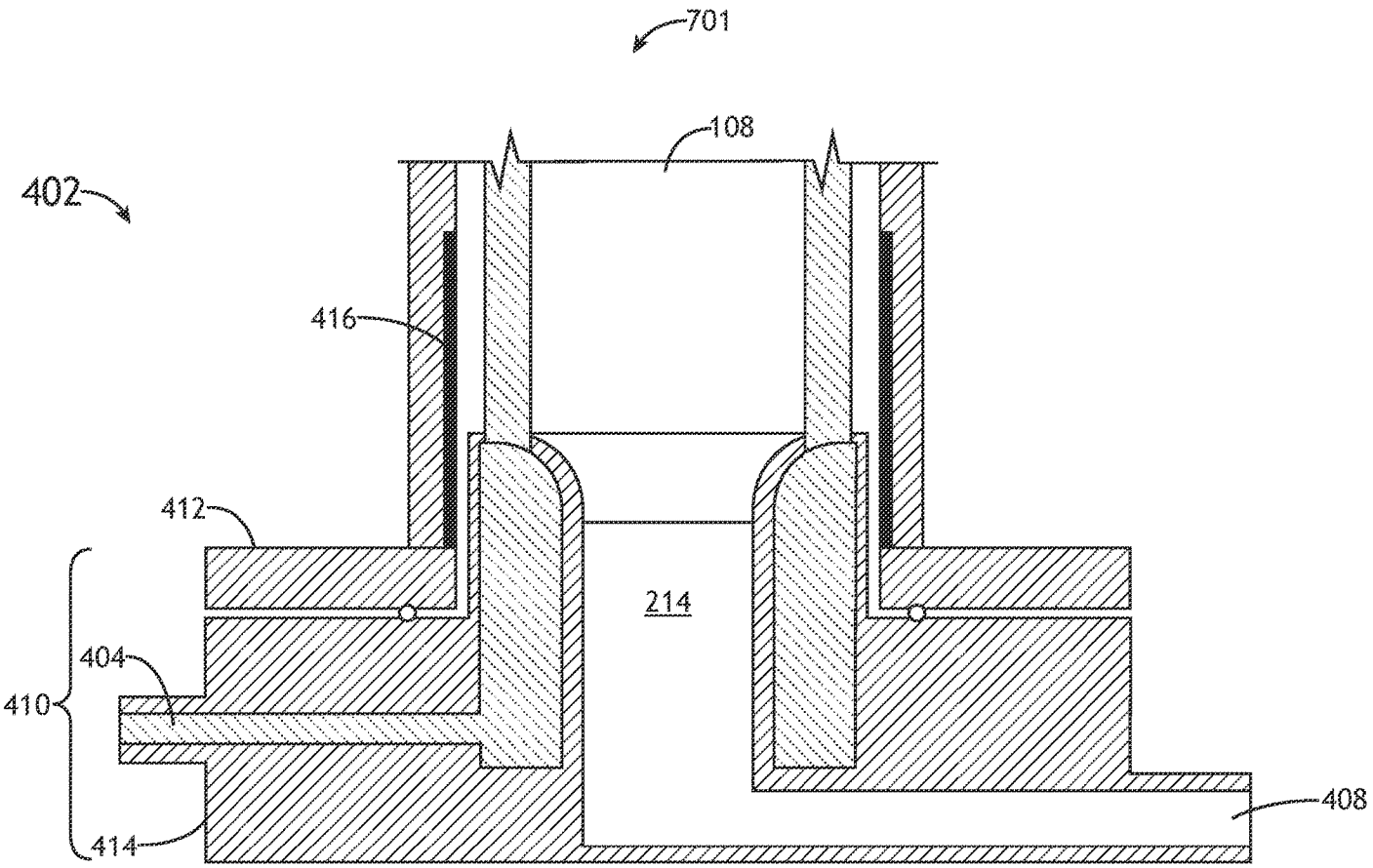
FIG. 4 is a schematic illustration of a gas distribution manifold of the reverse-flow vortex-generating gas cell, in accordance with one or more embodiments of the present disclosure.

FIG. 4 illustrates a schematic view of a gas distribution manifold 402 of the reverse-flow plasma cell, in accordance with one or more embodiments of the present disclosure. The distribution manifold 402 is configured to distribute gas into and out of the gas containment structure 108 of the reverse-flow vortex cell 101. In embodiments, the distribution manifold 402 includes a gas inlet manifold 404. Additionally, the gas distribution manifold 402 includes an inlet plenum 406. In embodiments, the delivery lines 206 are fluidically coupled to the inlet plenum 406. In this embodiment, gas is received by the intake manifold 404 and directed to the inlet plenum 406. The inlet plenum 406 then equally distributes gas to the delivery lines 206. In embodiments, the gas distribution manifold 402 includes a gas exhaust manifold 408. The gas exhaust manifold 408 is fluidically coupled to the outlet 214.

In embodiments, the distribution manifold is part of a flange assembly 410. For example, the flange assembly 410 may include a top flange 412 and a bottom flange 414. In this example, the top flange 412 may couple to the bottom flange 414, thereby hermetically sealing the end of the glass containment structure 108. In embodiments, the intake manifold 404 and the outlet manifold 408 may be integrated into the bottom flange 414 and the seal 416 may be integrated into the top flange 412 such that when the top flange 412 and the bottom flange 414 are coupled together the gas distribution pathway is complete and the end portion of the gas containment structure 108 is sealed.

Figure 5:
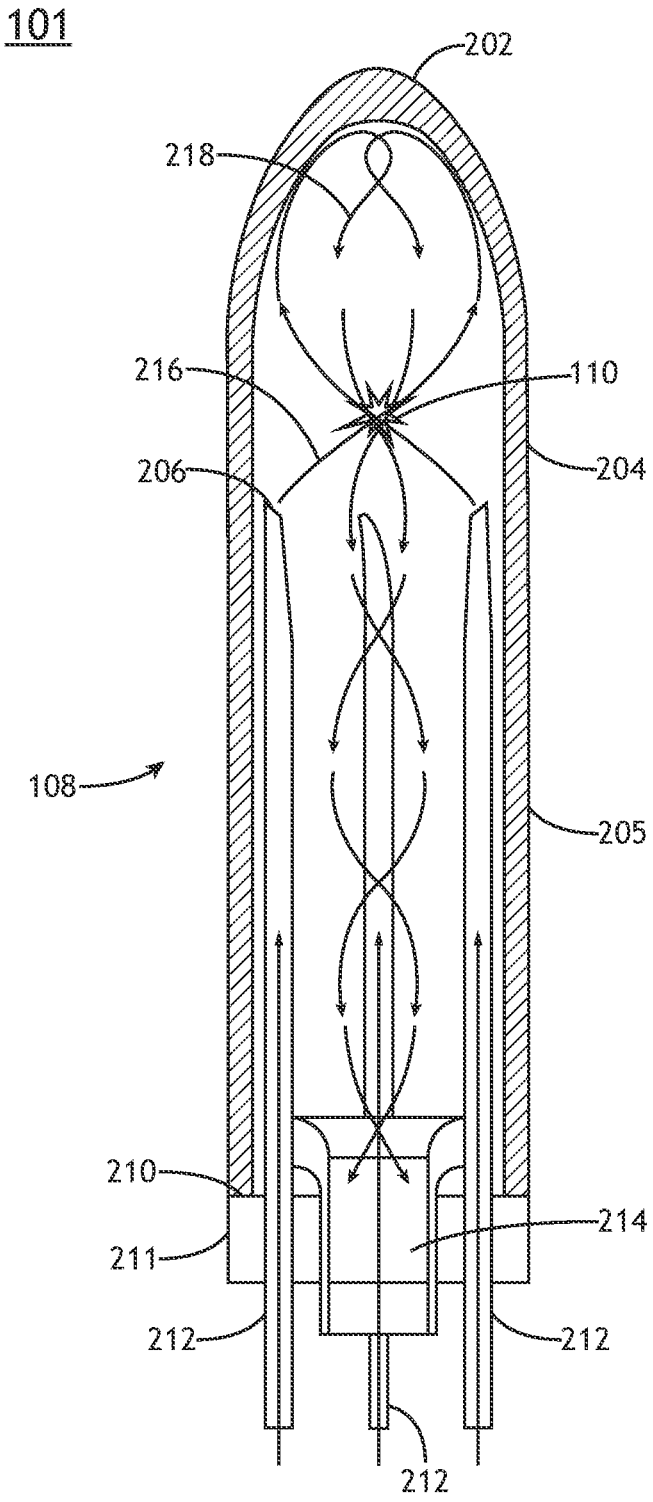
FIG. 5 is a schematic illustration of a reverse-flow vortex-generating gas cell having a cylindrical shape, in accordance with one or more embodiments of the present disclosure.

It is noted that the shape of the gas containment structure 108 of the plasma cell 101 may take on any shape and is not limited to the shape depicted previously herein. For example, as shown in FIG. 5, the shaft, neck, and body of the gas containment structure 108 may all have a cylindrical shape of the same diameter, resulting in a purely cylindrical lamp, with the top of the gas containment structure 108 maintaining a curved shape to maintain gas flow reversal.

Figure 6A:
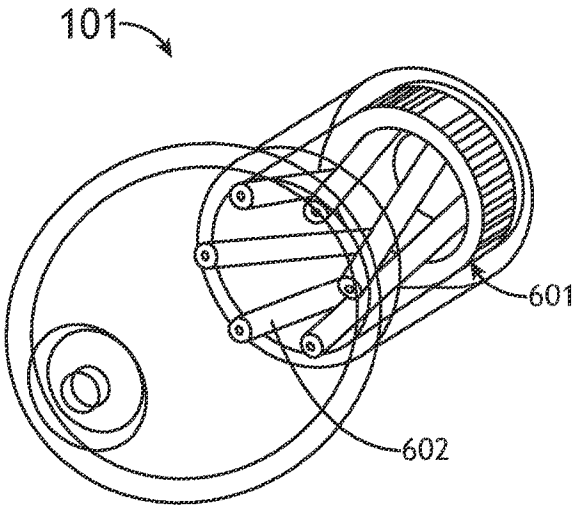
FIGS. 6A-6E are schematic illustrations of reverse-flow gas cell including multiple gas delivery lines and a gas outlet located at the center of the gas seal, in accordance with one or more embodiments of the present disclosure.
Figure 6B:
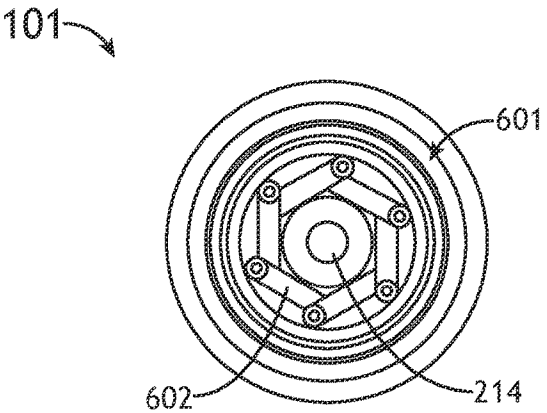
Figure 6C:
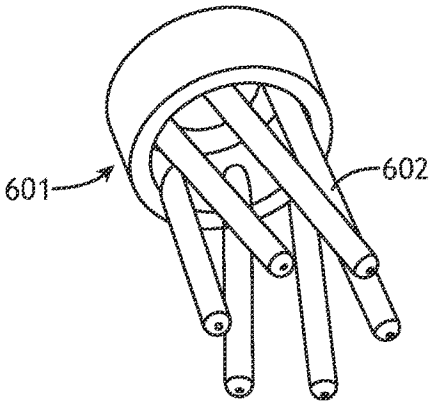
Figure 6D:
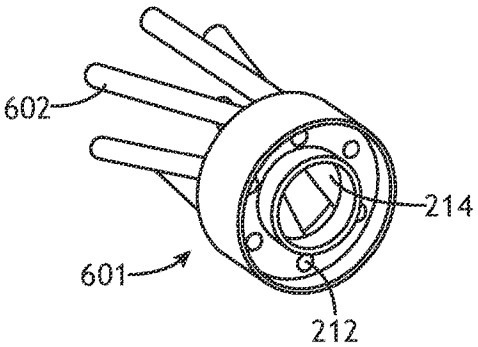
Figure 6E:
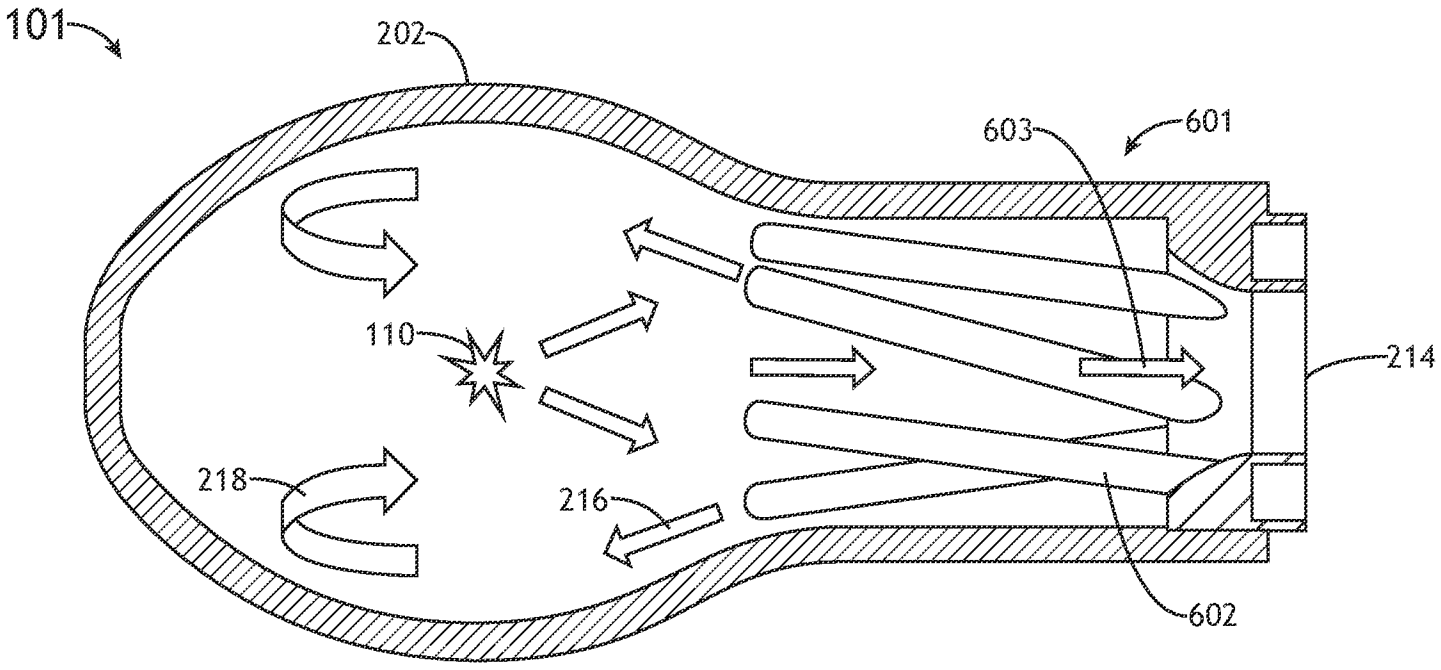
Figure 7C:
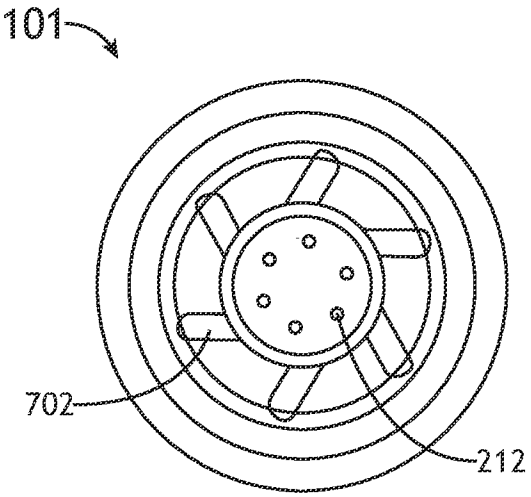
FIGS. 7A-7D are schematic illustrations of reverse-flow gas cell including multiple gas delivery lines and a gas outlet located at the periphery of the gas seal, in accordance with one or more embodiments of the present disclosure.
Figure 7B:
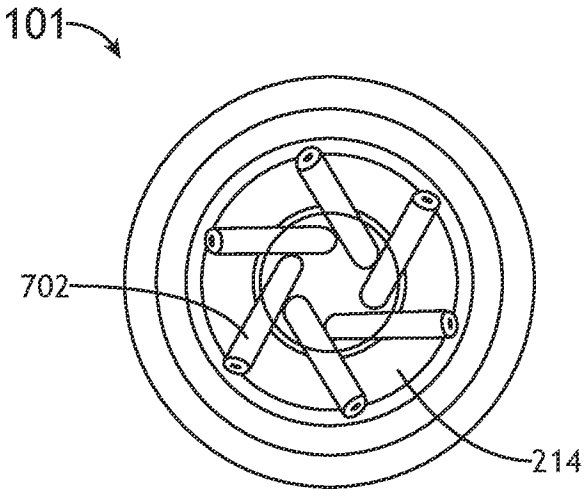
Figure 7A:
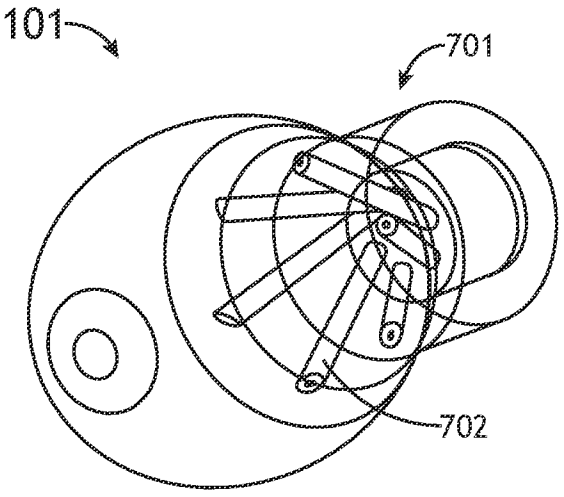
Figure 7D:
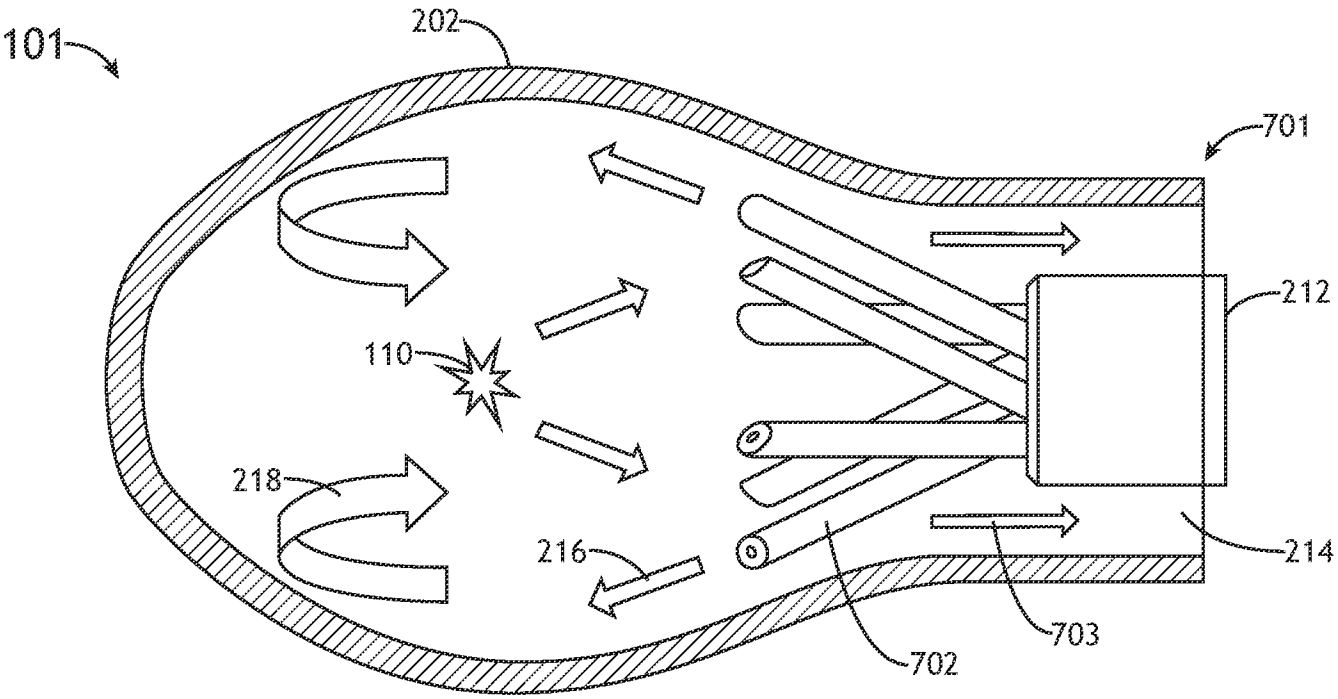

FIGS. 6A-6E illustrate a set of schematic diagrams of the reverse-flow plasma cell 101 including a set of inclined delivery lines 602, in accordance with one or more embodiments of the present disclosure. FIG. 6A is a perspective view of the reverse-flow plasma cell 101 equipped with the set of inclined delivery lines 602. FIG. 6B is a top view of the reverse-flow plasma cell 101 equipped with the set of inclined delivery lines 602. FIG. 6C is a top view of the delivery line assembly 601 including the gas delivery lines 602. FIG. 6D is a bottom view of the delivery line assembly 601 including the gas delivery lines 602. FIG. 6E is a cross-sectional view of the reverse-flow plasma cell 101 including the gas delivery lines 602.

In this embodiment, the construction of the delivery lines and nozzles is simplified by inclining the delivery lines. In this embodiment, the reverse-flow vortex cell 101 includes a delivery line assembly 601. The delivery line assembly 601 includes a set of delivery lines 602 arranged to generate a set of gas jets 216 that impinge the inner surface of the body 202 of the gas containment structure 108 in a spiral pattern. It is further noted that jets formed by the nozzles would have most of the propulsion force directed along the axes of delivery lines 602. In this embodiment, as shown in FIG. 6D, the gas inlets 212, which fluidically couple to the deliver lines 602, are located at the periphery of the gas containment structure 108, while the outlet 214 is located at the center of the gas containment structure 108.

FIGS. 7A-7D illustrate a set of schematic diagrams of the reverse-flow plasma cell 101 including a set of inclined delivery lines 702, in accordance with one or more alternative embodiments of the present disclosure. In this embodiment, the gas inlets 212 are located at a central region of the gas containment structure 108 and the gas outlet 214 is located at the periphery of the gas containment structure 108.

Any number of peripheral or centered inlet sets may be utilized within the cells of the present disclosure. The inlets and outlets and the rate of flow through them are to be configured depending on the desired flow regime. The location of the gas inlets 212 and gas outlets 214 as well as inclination and shapes of delivery lines 206 may be adjusted to suit other design goals (e.g., reducing diameter of lamp shaft and seal for better pressure handling).

Figure 8:
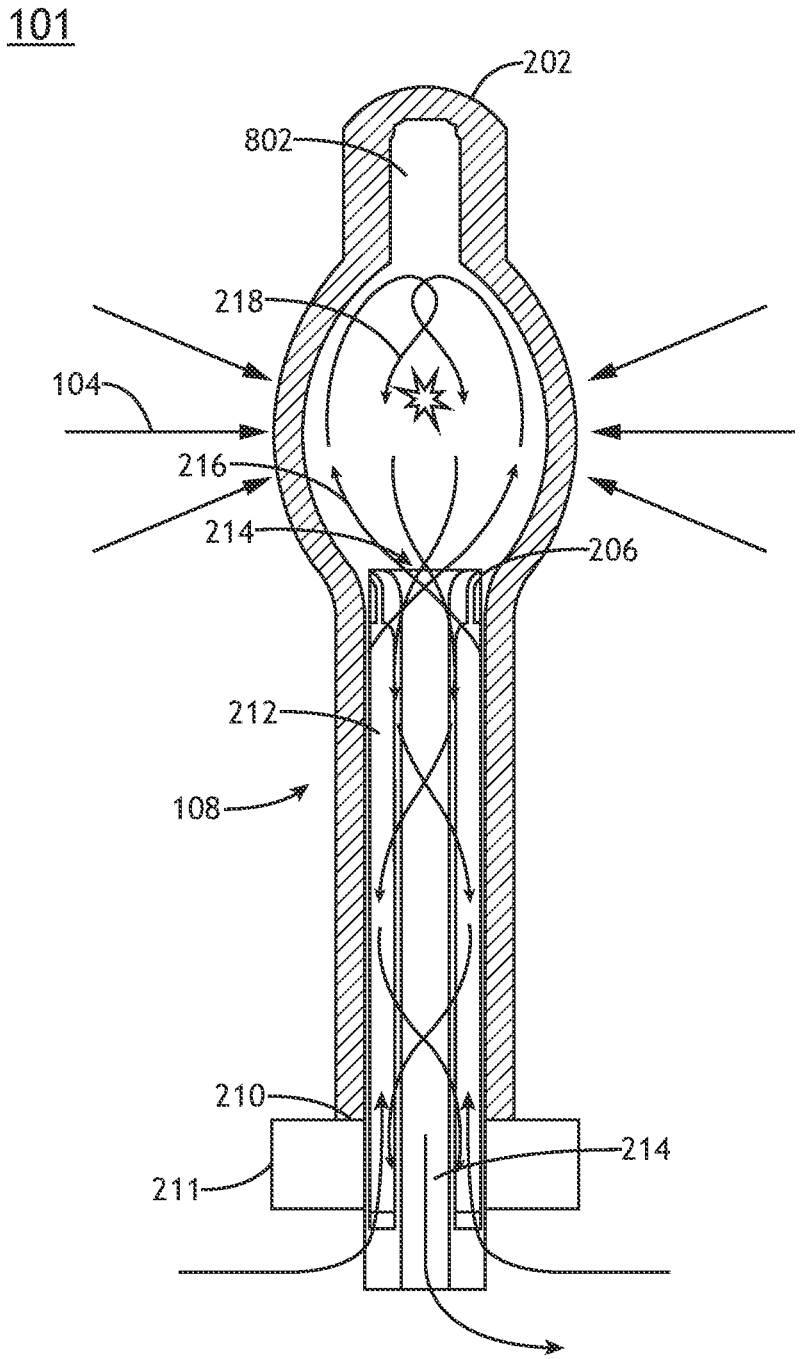
FIG. 8 is a schematic illustration of a reverse-flow vortex-generating gas cell including an extended top pocket, in accordance with one or more embodiments of the present disclosure.

FIG. 8 illustrates a simplified schematic view of the reverse-flow vortex cell 101 equipped with an extended top pocket 802, in accordance with one or more embodiments of the present disclosure. In embodiments, the gas inlets 212 are extended along the gas containment structure 108 such that the gas nozzles 206 are located at mouth of the body 202 of the gas containment structure 108. In addition, the extended top pocket 802 may be located opposite the gas nozzles 206. This extended top pocket 802 servers to create a large distance between the plasma 110 and the glass wall of the gas containment structure 108 in the top portion of the glass containment structure 108, where convection cooling is minimal.

The generation of a light-sustained plasma is also generally described in U.S. Pat. No. 7,435,982, issued on Oct. 14, 2008, which is incorporated by reference herein in the entirety. The generation of plasma is also generally described in U.S. Pat. No. 7,786,455, issued on Aug. 31, 2010, which is incorporated by reference herein in the entirety. The generation of plasma is also generally described in U.S. Pat. No. 7,989,786, issued on Aug. 2, 2011, which is incorporated by reference herein in the entirety. The generation of plasma is also generally described in U.S. Pat. No. 8,182,127, issued on May 22, 2012, which is incorporated by reference herein in the entirety. The generation of plasma is also generally described in U.S. Pat. No. 8,309,943, issued on Nov. 13, 2012, which is incorporated by reference herein in the entirety. The generation of plasma is also generally described in U.S. Pat. No. 8,525,138, issued on Feb. 9, 2013, which is incorporated by reference herein in the entirety. The generation of plasma is also generally described in U.S. Pat. No. 8,921,814, issued on Dec. 30, 2014, which is incorporated by reference herein in the entirety. The generation of plasma is also generally described in U.S. Pat. No. 9,318,311, issued on Apr. 19, 2016, which is incorporated by reference herein in the entirety. The generation of plasma is also generally described in U.S. Pat. No. 9,390,902, issued on Jul. 12, 2016, which is incorporated by reference herein in the entirety. In a general sense, the various embodiments of the present disclosure should be interpreted to extend to any plasma-based light source known in the art.

Referring generally to FIGS. 1-8, the pump source 102 may include any laser system known in the art capable of serving as an optical pump for sustaining a plasma. For instance, the pump source 102 may include any laser system known in the art capable of emitting radiation in the infrared, visible and/or ultraviolet portions of the electromagnetic spectrum.

In embodiments, the pump source 102 may include a laser system configured to emit continuous wave (CW) laser radiation. For example, the pump source 102 may include one or more CW infrared laser sources. In embodiments, the pump source 102 may include one or more lasers configured to provide laser light at substantially a constant power to the plasma 110. In embodiments, the pump source 102 may include one or more modulated lasers configured to provide modulated laser light to the plasma 110. In embodiments, the pump source 102 may include one or more pulsed lasers configured to provide pulsed laser light to the plasma. In embodiments, the pump source 102 may include one or more diode lasers. For example, the pump source 102 may include one or more diode lasers emitting radiation at a wavelength corresponding with any one or more absorption lines of the species of the gas contained within the gas containment structure. A diode laser of pump source 102 may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) will depend on the type of gas used in the light source 100. In embodiments, the pump source 102 may include an ion laser. For example, the pump source 102 may include any noble gas ion laser known in the art. For instance, in the case of an argon-based plasma, the pump source 102 used to pump argon ions may include an Ar+ laser. In embodiments, the pump source 102 may include one or more frequency converted laser systems. In embodiments, the pump source 102 may include a disk laser. In embodiments, the pump source 102 may include a fiber laser. In embodiments, the pump source 102 may include a broadband laser. In embodiments, the pump source 102 may include one or more non-laser sources. The pump source 102 may include any non-laser light source known in the art. For instance, the pump source 102 may include any non-laser system known in the art capable of emitting radiation discretely or continuously in the infrared, visible or ultraviolet portions of the electromagnetic spectrum.

In embodiments, the pump source 102 may include two or more light sources. In embodiments, the pump source 102 may include two or more lasers. For example, the pump source 102 (or "sources") may include multiple diode lasers. In embodiments, each of the two or more lasers may emit laser radiation tuned to a different absorption line of the gas or plasma within source 100.

The light collector element 106 may include any light collector element known in the art of plasma production. For example, the light collector element 106 may include one or more elliptical reflectors, one or more spherical reflectors, and/or one or more parabolic reflectors. The light collector element 106 may be configured to collect any wavelength of broadband light from the plasma 110 known in the art of plasma-based broadband light sources. For example, the light collector element 106 may be configured to collect infrared light, visible light, ultraviolet (UV) light, near ultraviolet (NUV), vacuum UV (VUV) light, and/or deep UV (DUV) light from the plasma 110.

The transmitting portion of the gas containment structure of source 100 (e.g., transmission element, bulb or window) may be formed from any material known in the art that is at least partially transparent to the broadband light 115 generated by plasma 110 and/or the pump light 104. In embodiments, one or more transmitting portions of the gas containment structure (e.g., transmission element, bulb or window) may be formed from any material known in the art that is at least partially transparent to VUV radiation, DUV radiation, UV radiation, NUV radiation and/or visible light generated within the gas containment structure. Further, one or more transmitting portions of the gas containment structure may be formed from any material known in the art that is at least partially transparent to IR radiation, visible light and/or UV light from the pump source 102. In embodiments, one or more transmitting portions of the gas containment structure may be formed from any material known in the art transparent to both radiation from the pump source 102 (e.g., IR source) and radiation (e.g., VUV, DUV, UV, NUV radiation and/or visible light) emitted by the plasma 110.

The gas containment structure 108 may contain any selected gas (e.g., argon, xenon, mercury or the like) known in the art suitable for generating a plasma upon absorption of pump illumination. In embodiments, the focusing of pump illumination 510 from the pump source 102 into the volume of gas causes energy to be absorbed by the gas or plasma (e.g., through one or more selected absorption lines) within the gas containment structure, thereby "pumping" the gas species in order to generate and/or sustain a plasma 110. In embodiments, although not shown, the gas containment structure may include a set of electrodes for initiating the plasma 110 within the internal volume of the gas containment structure 108, whereby the illumination from the pump source 102 maintains the plasma 110 after ignition by the electrodes.

The source 100 may be utilized to initiate and/or sustain the plasma 110 in a variety of gas environments. In embodiments, the gas used to initiate and/or maintain plasma 110 may include an inert gas (e.g., noble gas or non-noble gas) or a non-inert gas (e.g., mercury). In embodiments, the gas used to initiate and/or maintain a plasma 110 may include a mixture of gases (e.g., mixture of inert gases, mixture of inert gas with non-inert gas or a mixture of non-inert gases). For example, gases suitable for implementation in source 100 may include, but are not limited, to Xe, Ar, Ne, Kr, He, $N_2$, $H_2O$, $O_2$, $H_2$, $D_2$, $F_2$, $CH_4$, $CF_6$ one or more metal halides, a halogen, Hg, Cd, Zn, Sn, Ga, Fe, Li, Na, Ar:Xe, ArHg, KrHg, XeHg, and any mixture thereof. The present disclosure should be interpreted to extend to any gas suitable for sustaining a plasma within a gas containment structure.

In embodiments, the LSP light source 100 further includes one or more additional optics configured to direct the broadband light 115 from the plasma 110 to one or more downstream applications. The one or more additional optics may include any optical element known in the art including, but not limited to, one or more mirrors, one or more lenses, one or more filters, one or more beam splitters, or the like. The light collector element 106 may collect one or more of visible, NUV, UV, DUV, and/or VUV radiation emitted by plasma 110 and direct the broadband light 115 to one or more downstream optical elements. For example, the light collector element 106 may deliver infrared, visible, NUV, UV, DUV, and/or VUV radiation to downstream optical elements of any optical characterization system known in the art, such as, but not limited to, an inspection tool, a metrology tool, or a lithography tool. In this regard, the broadband light 115 may be coupled to the illumination optics of an inspection tool, metrology tool, or lithography tool.

Figure 9:
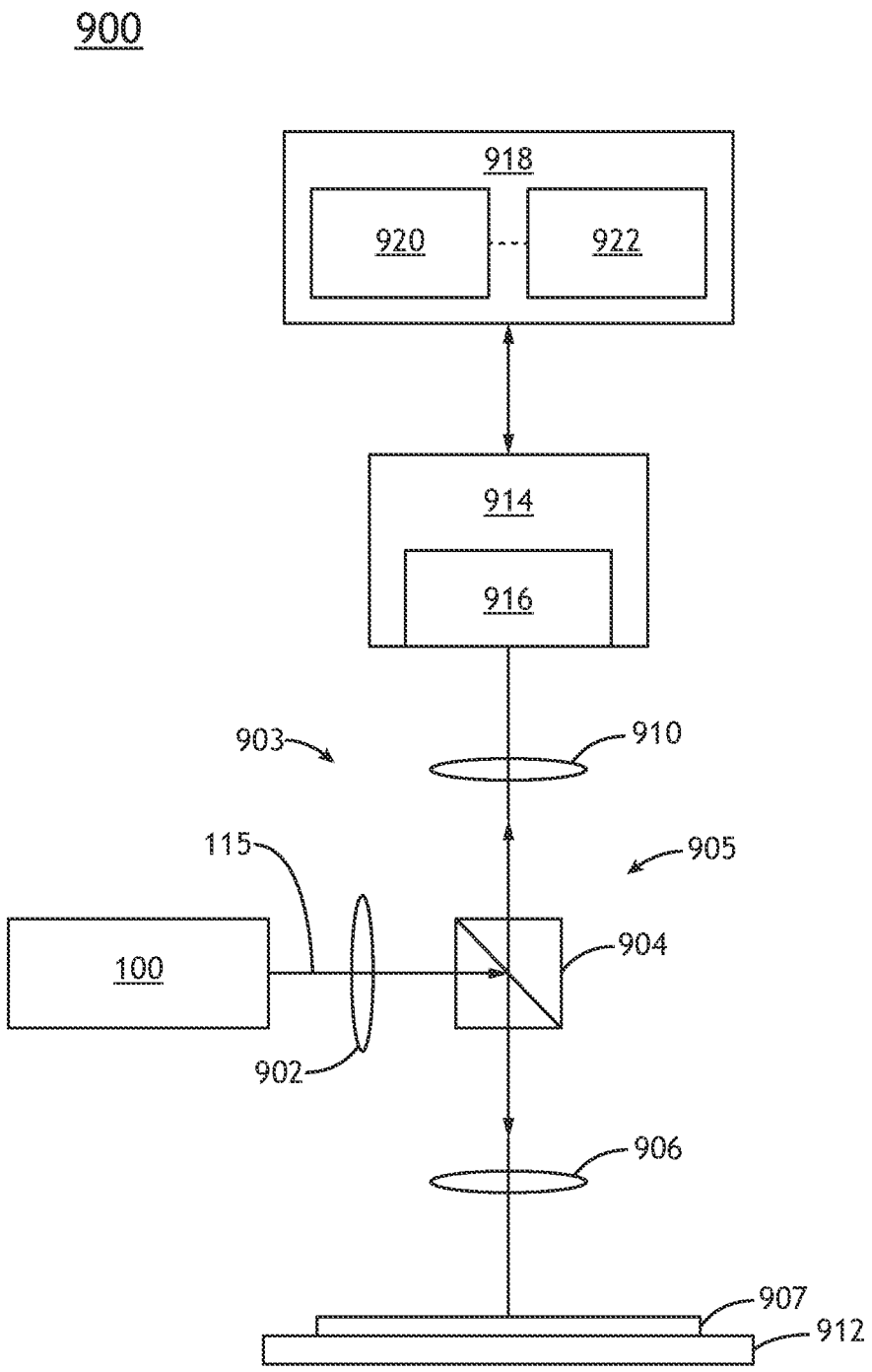
FIG. 9 is a simplified schematic illustration of an optical characterization system implementing an the LSP broadband light source illustrated in any of FIGS. 1 through 8, in accordance with one or more embodiments of the present disclosure.

FIG. 9 is a schematic illustration of an optical characterization system 900 implementing the LSP broadband light source 100 illustrated in any of FIGS. 1 through 8 (or any combination thereof), in accordance with one or more embodiments of the present disclosure.

It is noted herein that system 900 may comprise any imaging, inspection, metrology, lithography, or other characterization/fabrication system known in the art. In this regard, system 900 may be configured to perform inspection, optical metrology, lithography, and/or imaging on a sample 907. Sample 907 may include any sample known in the art including, but not limited to, a wafer, a reticle/photomask, and the like. It is noted that system 900 may incorporate one or more of the various embodiments of the LSP broadband light source 100 described throughout the present disclosure.

In embodiments, sample 907 is disposed on a stage assembly 912 to facilitate movement of sample 907. The stage assembly 912 may include any stage assembly 912 known in the art including, but not limited to, an X-Y stage, an R-8 stage, and the like. In embodiments, stage assembly 912 is capable of adjusting the height of sample 907 during inspection or imaging to maintain focus on the sample 907.

In embodiments, the set of illumination optics 903 is configured to direct illumination from the broadband light source 100 to the sample 907. The set of illumination optics 903 may include any number and type of optical components known in the art. In embodiments, the set of illumination optics 903 includes one or more optical elements such as, but not limited to, one or more lenses 902, a beam splitter 904, and an objective lens 906. In this regard, set of illumination optics 903 may be configured to focus illumination from the LSP broadband light source 100 onto the surface of the sample 907. The one or more optical elements may include any optical element or combination of optical elements known in the art including, but not limited to, one or more mirrors, one or more lenses, one or more polarizers, one or more gratings, one or more filters, one or more beam splitters, and the like.

In embodiments, the set of collection optics 905 is configured to collect light reflected, scattered, diffracted, and/or emitted from sample 907. In embodiments, the set of collection optics 905, such as, but not limited to, focusing lens 910, may direct and/or focus the light from the sample 907 to a sensor 916 of a detector assembly 914. It is noted that sensor 916 and detector assembly 914 may include any sensor and detector assembly known in the art. For example, the sensor 916 may include, but is not limited to, a charge-coupled device (CCD) detector, a complementary metal-oxide semiconductor (CMOS) detector, a time-delay integration (TDI) detector, a photomultiplier tube (PMT), an avalanche photodiode (APD), and the like. Further, sensor 916 may include, but is not limited to, a line sensor or an electron-bombarded line sensor.

In embodiments, detector assembly 914 is communicatively coupled to a controller 918 including one or more processors 920 and memory medium 922. For example, the one or more processors 920 may be communicatively coupled to memory 922, wherein the one or more processors 920 are configured to execute a set of program instructions stored on memory 922. In embodiments, the one or more processors 920 are configured to analyze the output of detector assembly 914. In embodiments, the set of program instructions are configured to cause the one or more processors 920 to analyze one or more characteristics of sample 907. In embodiments, the set of program instructions are configured to cause the one or more processors 920 to modify one or more characteristics of system 900 in order to maintain focus on the sample 907 and/or the sensor 916. For example, the one or more processors 920 may be configured to adjust the objective lens 906 or one or more optical elements 902 in order to focus illumination from LSP broadband light source 100 onto the surface of the sample 907. By way of another example, the one or more processors 920 may be configured to adjust the objective lens 906 and/or one or more optical elements 902 in order to collect illumination from the surface of the sample 907 and focus the collected illumination on the sensor 916.

It is noted that the system 900 may be configured in any optical configuration known in the art including, but not limited to, a dark-field configuration, a bright-field orientation, and the like.

Figure 10:
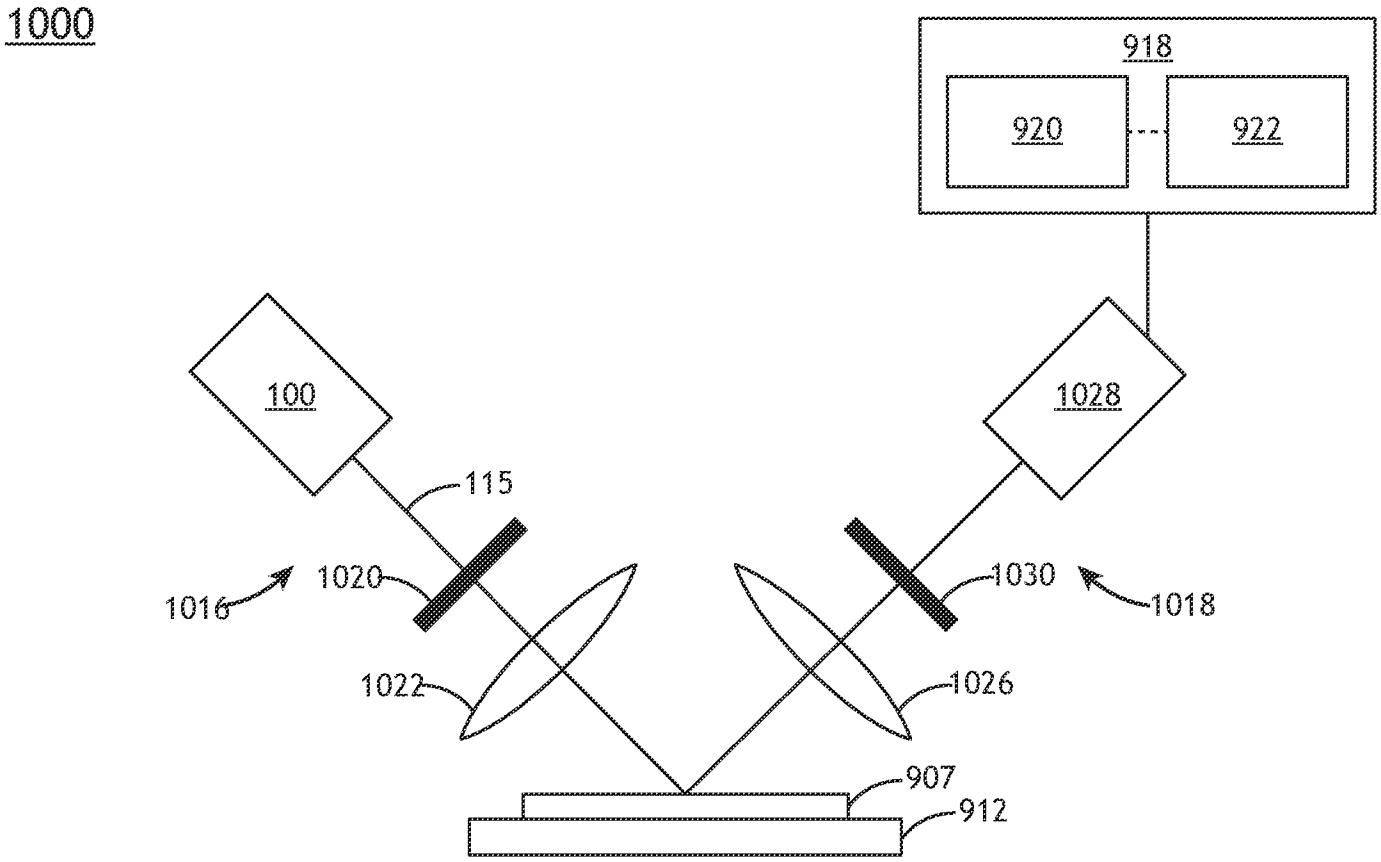
FIG. 10 is a simplified schematic illustration of an optical characterization system implementing an the LSP broadband light source illustrated in any of FIGS. 1 through 8, in accordance with one or more embodiments of the present disclosure.

FIG. 10 illustrates a simplified schematic diagram of an optical characterization system 1000 arranged in a reflectometry and/or ellipsometry configuration, in accordance with one or more embodiments of the present disclosure. It is noted that the various embodiments and components described with respect to FIGS. 1 through 9 may be interpreted to extend to the system of FIG. 10. The system 1000 may include any type of metrology system known in the art.

In embodiments, system 1000 includes the LSP broadband light source 100, a set of illumination optics 1016, a set of collection optics 1018, a detector assembly 1028, and the controller 918 including the one or more processors 920 and memory 922.

In this embodiment, the broadband illumination from the LSP broadband light source 100 is directed to the sample 907 via the set of illumination optics 1016. In embodiments, the system 1000 collects illumination emanating from the sample via the set of collection optics 1018. The set of illumination optics 1016 may include one or more beam conditioning components 1020 suitable for modifying and/or conditioning the broadband beam. For example, the one or more beam conditioning components 1020 may include, but are not limited to, one or more polarizers, one or more filters, one or more beam splitters, one or more diffusers, one or more homogenizers, one or more apodizers, one or more beam shapers, or one or more lenses.

In embodiments, the set of illumination optics 1016 may utilize a first focusing element 1022 to focus and/or direct the beam onto the sample 907 disposed on the sample stage 1012. In embodiments, the set of collection optics 1018 may include a second focusing element 1026 to collect illumination from the sample 907.

In embodiments, the detector assembly 1028 is configured to capture illumination emanating from the sample 907 through the set of collection optics 1018. For example, the detector assembly 1028 may receive illumination reflected or scattered (e.g., via specular reflection, diffuse reflection, and the like) from the sample 907. By way of another example, the detector assembly 1028 may receive illumination generated by the sample 907 (e.g., luminescence associated with absorption of the beam, and the like). It is noted that detector assembly 1028 may include any sensor and detector assembly known in the art. For example, the sensor may include, but is not limited to, CCD detector, a CMOS detector, a TDI detector, a PMT, an APD, and the like.

The set of collection optics 1018 may further include any number of collection beam conditioning elements 1030 to direct and/or modify illumination collected by the second focusing element 1026 including, but not limited to, one or more lenses, one or more filters, one or more polarizers, or one or more phase plates.

The system 1000 may be configured as any type of metrology tool known in the art such as, but not limited to, a spectroscopic ellipsometer with one or more angles of illumination, a spectroscopic ellipsometer for measuring Mueller matrix elements (e.g., using rotating compensators), a single-wavelength ellipsometer, an angle-resolved ellipsometer (e.g., a beam-profile ellipsometer), a spectroscopic reflectometer, a single-wavelength reflectometer, an angle-resolved reflectometer (e.g., a beam-profile reflectometer), an imaging system, a pupil imaging system, a spectral imaging system, or a scatterometer.

A description of an inspection/metrology tools suitable for implementation in the various embodiments of the present disclosure are provided in U.S. Pat. No. 7,957,066, entitled "Split Field Inspection System Using Small Catadioptric Objectives," issued on Jun. 7, 2011; U.S. Pat. No. 7,345,825, entitled "Beam Delivery System for Laser Dark-Field Illumination in a Catadioptric Optical System," issued on Mar. 18, 2018; U.S. Pat. No. 5,999,310, entitled "Ultra-broadband UV Microscope Imaging System with Wide Range Zoom Capability," issued on Dec. 7, 1999; U.S. Pat. No. 7,525,649, entitled "Surface Inspection System Using Laser Line Illumination with Two Dimensional Imaging," issued on Apr. 28, 2009; U.S. Pat. No. 9,228,943, entitled "Dynamically Adjustable Semiconductor Metrology System," issued on Jan. 5, 2016; U.S. Pat. No. 5,608,526, entitled "Focused Beam Spectroscopic Ellipsometry Method and System, by Piwonka-Corle et al., issued on Mar. 4, 1997; and U.S. Pat. No. 6,297,880, entitled "Apparatus for Analyzing Multi-Layer Thin Film Stacks on Semiconductors," issued on Oct. 2, 2001, which are each incorporated herein by reference in their entirety.

The one or more processors 920 of controller 918 may include any processor or processing element known in the art. For the purposes of the present disclosure, the term "processor" or "processing element" may be broadly defined to encompass any device having one or more processing or logic elements (e.g., one or more micro-processor devices, one or more application specific integrated circuit (ASIC) devices, one or more field programmable gate arrays (FPGAs), or one or more digital signal processors (DSPs)). In this sense, the one or more processors 920 may include any device configured to execute algorithms and/or instructions (e.g., program instructions stored in memory) from a memory medium 922. The memory medium 922 may include any storage medium known in the art suitable for storing program instructions executable by the associated one or more processors 920.

In embodiments, the LSP light source 100 and systems 900, 1000, as described herein, may be configured as a "stand alone tool," interpreted herein as a tool that is not physically coupled to a process tool. In other embodiments, such an inspection or metrology system may be coupled to a process tool (not shown) by a transmission medium, which may include wired and/or wireless portions. The process tool may include any process tool known in the art such as a lithography tool, an etch tool, a deposition tool, a polishing tool, a plating tool, a cleaning tool, or an ion implantation tool. The results of inspection or measurement performed by the systems described herein may be used to alter a parameter of a process or a process tool using a feedback control technique, a feedforward control technique, and/or an in-situ control technique. The parameter of the process or the process tool may be altered manually or automatically.

One skilled in the art will recognize that the herein described components operations, devices, objects, and the discussion accompanying them are used as examples for the sake of conceptual clarity and that various configuration modifications are contemplated. Consequently, as used herein, the specific exemplars set forth and the accompanying discussion are intended to be representative of their more general classes. In general, use of any specific exemplar is intended to be representative of its class, and the non-inclusion of specific components, operations, devices, and objects should not be taken as limiting.

With respect to the use of substantially any plural and/or singular terms herein, those having skill in the art can translate from the plural to the singular and/or from the singular to the plural as is appropriate to the context and/or application. The various singular/plural permutations are not expressly set forth herein for sake of clarity.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected," or "coupled," to each other to achieve the desired functionality, and any two components capable of being so associated can also be viewed as being "couplable," to each other to achieve the desired functionality. Specific examples of couplable include but are not limited to physically mateable and/or physically interacting components and/or wirelessly interactable and/or wirelessly interacting components and/or logically interacting and/or logically interactable components.

Furthermore, it is to be understood that the invention is defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," and the like). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, and the like" is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, and the like). In those instances where a convention analogous to "at least one of A, B, or C, and the like" is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, and the like). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A laser-sustained light source comprising:

a gas containment structure for containing a gas, wherein the gas containment structure comprises a body, a neck, and a shaft;

a plurality of nozzles position in or below the neck of the gas containment structure;

a plurality of gas delivery lines fluidically coupled to the plurality of nozzles and configured to deliver gas to the plurality of nozzles;

one or more gas inlets fluidically coupled to the gas delivery lines for providing gas into the plurality of gas delivery lines;

one or more gas outlets fluidically coupled to the gas containment structure and configured to flow gas out of the gas containment structure, wherein the one or more gas inlets and the one or more gas outlets are arranged to generate a vortex gas flow within the gas containment structure;

a gas seal positioned at a base of the gas containment structure;

a laser pump source configured to generate an optical pump to sustain a plasma in a region of the gas containment structure within an inner gas flow within the vortex gas flow; and a light collector element configured to collect at least a portion of broadband light emitted from the plasma.

2. The laser-sustained source of claim 1, wherein the plurality of nozzles are configured to generate a plurality of gas jets in a spiral pattern impinging on an inner surface of the body of the gas containment structure.

3. The laser-sustained source of claim 1, wherein the plurality of nozzles, the body, and the one or more gas outlets are arranged to generate a reverse vortex gas flow within the body of the gas containment structure.

4. The laser-sustained source of claim 3, wherein a gas flow from the one or more inlets and a gas flow into the one or more outlets are propagating in opposite directions.

5. The laser-sustained source of claim 1, wherein the plurality of nozzles comprises between 2 and 10 nozzles.

6. The laser-sustained source of claim 1, wherein the one or more delivery lines are inclined in a spiral arrangement.

7. The laser-sustained source of claim 6, wherein the one or more gas inlets are positioned at the periphery of the gas seal and the one or more outlets are positioned at the center of the gas seal.

8. The laser-sustained source of claim 6, wherein the one or more gas inlets are positioned at the periphery of the gas seal and the one or more outlets are positioned at the periphery of the gas seal.

9. The laser-sustained source of claim 1, further comprising:

a distribution manifold.

10. The laser-sustained source of claim 9, wherein the distribution manifold comprises:

an inlet manifold; and an inlet plenum, wherein the plurality of delivery lines are fluidically coupled to the inlet plenum.

11. The laser-sustained source of claim 10, wherein the distribution manifold comprises:

an exhaust manifold fluidically coupled to the one or more outlets.

12. The laser-sustained source of claim 1, further comprising a binding, wherein the binding is applied to at least one of the one or more delivery lines or the one or more nozzles to stabilize the one or more nozzles.

13. The laser-sustained source of claim 12, wherein the binding is located in a shadow of the neck for protection from the broadband light from the plasma.

14. The laser-sustained source of claim 1, further comprising optical shielding applied to the one or more delivery lines and configured to shield the gas seal from the broadband light from the plasma.

15. The broadband laser-sustained source of claim 1, wherein the one or more gas inlets are positioned on the same side of the gas containment structure as the one or more gas outlets.

16. The broadband laser-sustained source of claim 15, wherein the vortex gas flow direction through the plasma region is in an opposite direction of an inlet gas flow from the one or more inlets.

17. The laser-sustained source of claim 1, wherein the plurality of nozzles and the one or more outlets are positioned at a bottom portion of the body of the gas containment structure.

18. The laser-sustained source of claim 17, wherein the body includes an extended pocket located opposite of the plurality of nozzles.

19. The laser-sustained source of claim 1, wherein the body of the gas containment structure comprises at least one of cylindrical body, a spherical body, or an ellipsoidal body.

20. The laser-sustained light source of claim 1, wherein the gas containment structure comprises at least one of a plasma cell, a plasma bulb, or a plasma chamber.

21. The laser-sustained light source of claim 1, wherein the gas contained within the gas containment structure comprises at least one Xe, Ar, Ne, Kr, He $N_2$, $H_2O$, $O_2$, $H_2$, $D_2$, $F_2$, $CF_6$, or a mixture of two or more Xe, Ar, Ne, Kr, He, $N_2$, $H_2O$, $O_2$, $H_2$, $D_2$, $F_2$, or $CF_6$.

22. The laser-sustained light source of claim 1, wherein the light collector element comprises an elliptical, parabolical, or spherical light collector element.

23. The laser-sustained light source of claim 1, wherein the pump source comprises:

one or more lasers.

24. The laser-sustained light source of claim 23, wherein the pump source comprises:

at least one of an infrared laser, a visible laser, or an ultraviolet laser.

25. The laser-sustained light source of claim 1, wherein the light collector element is configured to collect at least one of broadband infrared, visible, UV, VUV, or DUV light from the plasma.

26. The laser-sustained light source of claim 1, further comprising: one or more additional collection optics configured to direct a broadband light output from the plasma to one or more downstream applications.

27. The laser-sustained light source of claim 26, wherein the one or more downstream applications comprises at least one of inspection or metrology.

28. A characterization system comprising:

a laser-sustained light source comprising:

a gas containment structure for containing a gas, wherein the gas containment structure comprises a body, a neck, and a shaft;

a plurality of nozzles position in or below the neck of the gas containment structure;

a plurality of gas delivery lines fluidically coupled to the plurality of nozzles and configured to deliver gas to the plurality of nozzles;

one or more gas inlets fluidically coupled to the gas delivery lines for providing gas into the plurality of gas delivery lines;

one or more gas outlets fluidically coupled to the gas containment structure and configured to flow gas out of the gas containment structure, wherein the one or more gas inlets and the one or more gas outlets are arranged to generate a vortex gas flow within the gas containment structure;

a gas seal positioned at a base of the gas containment structure;

a laser pump source configured to generate an optical pump to sustain a plasma in a region of the gas containment structure within an inner gas flow within the vortex gas flow; and a light collector element configured to collect at least a portion of broadband light emitted from the plasma;

a set of illumination optics configured to direct broadband light from the laser-sustained light source to one or more samples;

a set of collection optics configured to collect light emanating from the one or more samples; and a detector assembly.

29. A plasma cell comprising:

a gas containment structure for containing a gas, wherein the gas containment structure comprises a body, a neck, and a shaft;

a plurality of nozzles position in or below the neck of the gas containment structure;

a plurality of gas delivery lines fluidically coupled to the plurality of nozzles and configured to deliver gas to the plurality of nozzles;

one or more gas inlets fluidically coupled to the gas delivery lines for providing gas into the plurality of gas delivery lines;

one or more gas outlets fluidically coupled to the gas containment structure and configured to flow gas out of the gas containment structure, wherein the one or more gas inlets and the one or more gas outlets are arranged to generate a vortex gas flow within the gas containment structure; and a gas seal positioned at a base of the gas containment structure, wherein the gas containment structure is configured to receive an optical pump to sustain a plasma within the vortex gas flow.

* * * * *